US006590175B1

(12) United States Patent
Lam

(10) Patent No.: US 6,590,175 B1
(45) Date of Patent: Jul. 8, 2003

(54) ILLUMINATED ROCKER SWITCH WITH RESISTOR

(75) Inventor: Hin Ming Lam, Chai Wan (HK)

(73) Assignee: Defond Manufacturing Limited, Chai Wan (HK)

( * ) Notice: Subject to any disclaimer, the term of this patent is extended or adjusted under 35 U.S.C. 154(b) by 0 days.

(21) Appl. No.: 10/159,021

(22) Filed: Jun. 3, 2002

(51) Int. Cl.[7] ..... H01H 9/00; H01H 21/00; H01H 21/18

(52) U.S. Cl. ..... 200/315; 200/553; 200/562

(58) Field of Search ..... 200/315, 308–314, 200/316, 317, 553–563

(56) References Cited

U.S. PATENT DOCUMENTS 3,609,268 A * 9/1971 Sanchez ..... 200/315
4,347,417 A * 8/1982 Sorenson ..... 200/315 X
4,431,880 A * 2/1984 Ives ..... 200/315
4,454,400 A * 6/1984 Sorenson ..... 200/315
5,105,059 A * 4/1992 Sorenson et al. ..... 200/315 X
5,451,733 A * 9/1995 Olson et al. ..... 200/315
5,496,981 A * 3/1996 Sorenson ..... 200/315
6,103,982 A * 8/2000 Chien ..... 200/315

* cited by examiner

*Primary Examiner*—J. R. Scott
(74) *Attorney, Agent, or Firm*—Leydig, Voit & Mayer, Ltd.

(57) ABSTRACT

An electrical switch, such as a rocker switch, includes a casing, three fixed contacts, each contact having an inner end, and an operating rocker movable between an operating position and a non-operating position. The switch includes a moving contact movable by the rocker to make and break electrical connection between the inner ends of a first pair of the fixed contacts (connectable to a load and a power source) while the rocker is in the operating and non-operating positions, respectively. Also included are a light bulb, lighting to indicate when the rocker is in the operating position, and an associated resistor. The light bulb and resistor are connectable in series across the inner ends of a second pair of the fixed contacts (connectable to a power source) when the rocker is in the operating position. The resistor is fixed, has a body, and has first and second terminals. The first terminal is a contact pad on the body, in direct engagement with the inner end of one of the fixed contacts of the second pair of fixed contacts for electrical connection to the fixed contact, and is fixed in position. The resistor is preferably a surface mounted device resistor.

16 Claims, 4 Drawing Sheets

FIG. 4
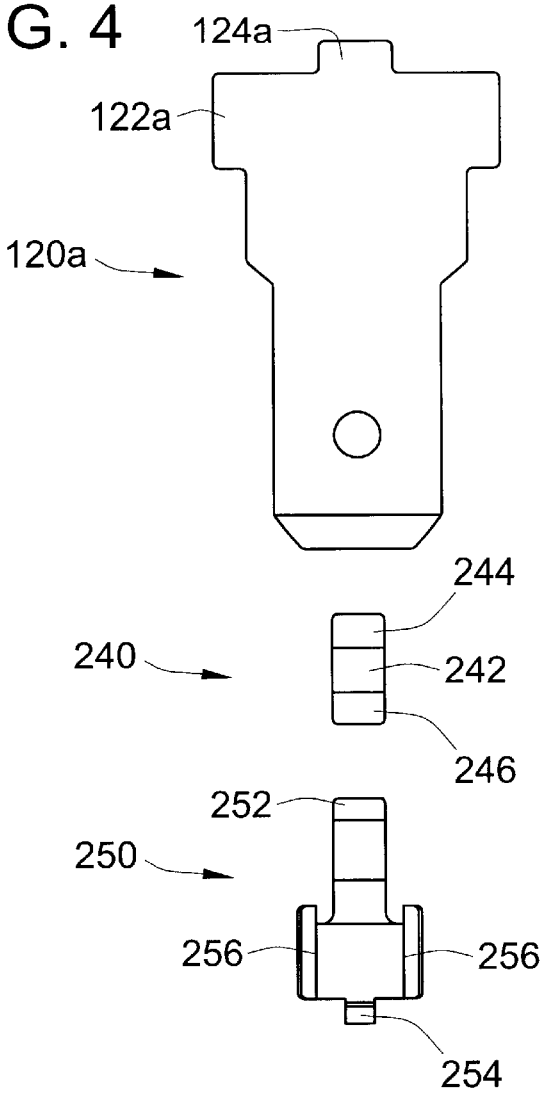
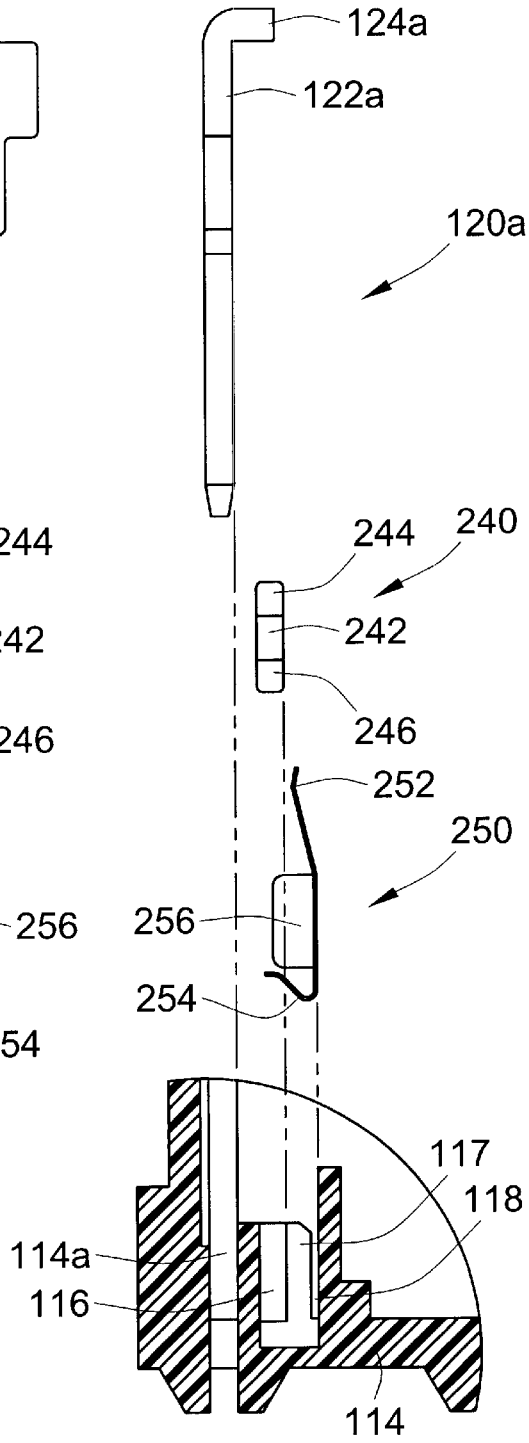
FIG. 3
FIG. 7
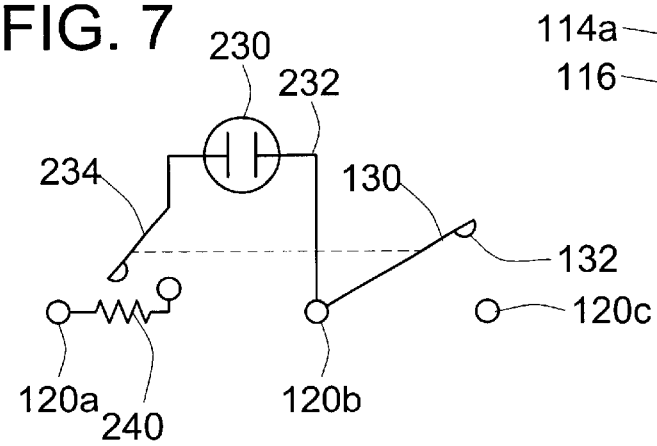

ILLUMINATED ROCKER SWITCH WITH RESISTOR

The present invention relates to an electrical switch that incorporates a small light to indicate the switched on condition.

BACKGROUND OF THE INVENTION

Electrical switches of this type are known, in which the light often requires a resistor connected in series for proper operation. The resistor takes up space, and hence the size of the switch is inevitably increased. Added to this is the connection and fixing of the resistor that usually involve crimping or soldering during the assembly process.

The subject invention seeks to mitigate or at least alleviate such problems by providing an improved electrical switch of this type.

SUMMARY OF THE INVENTION

According to the invention, there is provided an electrical switch comprising a casing, at least three fixed contacts extending from inside to outside the casing, each of the contacts having an inner end portion, and an operating member supported within the casing for movement between an operating position and an inoperating position. The switch includes an internal moving contact movable by the operating member to make and break electrical connection between the inner end portions of a first pair of the fixed contacts while the operating member is in the operating and inoperating positions respectively. This pair of contacts is connectable to a load and a power source. Also included are an internal lighting element for lighting up to indicate when the operating member is in the operating position, and an internal resistor for the lighting element. The lighting element and resistor are connectable in series across the inner end portions of a second pair of the fixed contacts when the operating member is in the operating position. This pair of contacts is connectable to a power source. The resistor is located in a fixed position and has a body and first and second terminals. The first terminal comprises a contact pad provided on a surface of the body and in direct engagement with the inner end portion of one of the fixed contacts of the second pair for electrical connection therewith and being fixed in position.

Preferably, the inner end portion of the one fixed contact of the second pair has a part that protrudes laterally outwards and engages with the first switch terminal, with the resistor body lying adjacent and substantially parallel to the contact end portion.

In a preferred embodiment, the second resistor terminal comprises another contact pad which is provided on a surface of the resistor body and is in direct engagement with an electrical connector for connection to a first terminal of the lighting element.

More preferably, the resistor body has opposite end surfaces on which its two terminals are provided, and the resistor is clamped at its opposite terminals between the inner end portion of the one fixed contact of the second pair and a part of the connector.

Further more preferably, the resistor is located between the inner end portion of the one fixed contact of the second pair and the connector, in a substantially co-parallel manner.

In a specific construction, the lighting element is located within the operating member, including a second terminal that is connected to the moving contact.

More specifically, the first terminal of the lighting element is supported by the operating member for movement thereby to contact with the connector when the operating member is in the operating position.

It is preferred that in general, the lighting element is located within the operating member, and has a first terminal movable by the operating member for connection to the second terminal of the resistor when the operating member is in the operating position. The lighting element includes a second terminal connected to the moving contact.

Conveniently, the casing includes a slot receiving the resistor, both of which have practically the same cross-section.

It is preferred that the resistor body has a substantially flat rectangular configuration.

It is preferred that the resistor is a surface mounted device.

In a specific example, the electrical switch is a rocker switch, in which the operating member is supported for pivotal movement between the operating and the inoperating positions, and the moving contact is supported for pivotal movement by the operating member in opposite direction.

BRIEF DESCRIPTION OF DRAWINGS

The invention will now be more particularly described, by way of example only, with reference to the accompanying drawings, in which:

FIG. 3 is an exploded side view of part of the switch of FIG. 1, showing how the resistor is located inside a switch casing between a switch contact and a connector;

FIG. 4 is a front view of the switch contact, resistor and connector of FIG. 3;

FIG. 7 is a schematic circuit diagram of the switch of FIG. 1.

DETAILED DESCRIPTION OF PREFERRED EMBODIMENT

Figure 1:
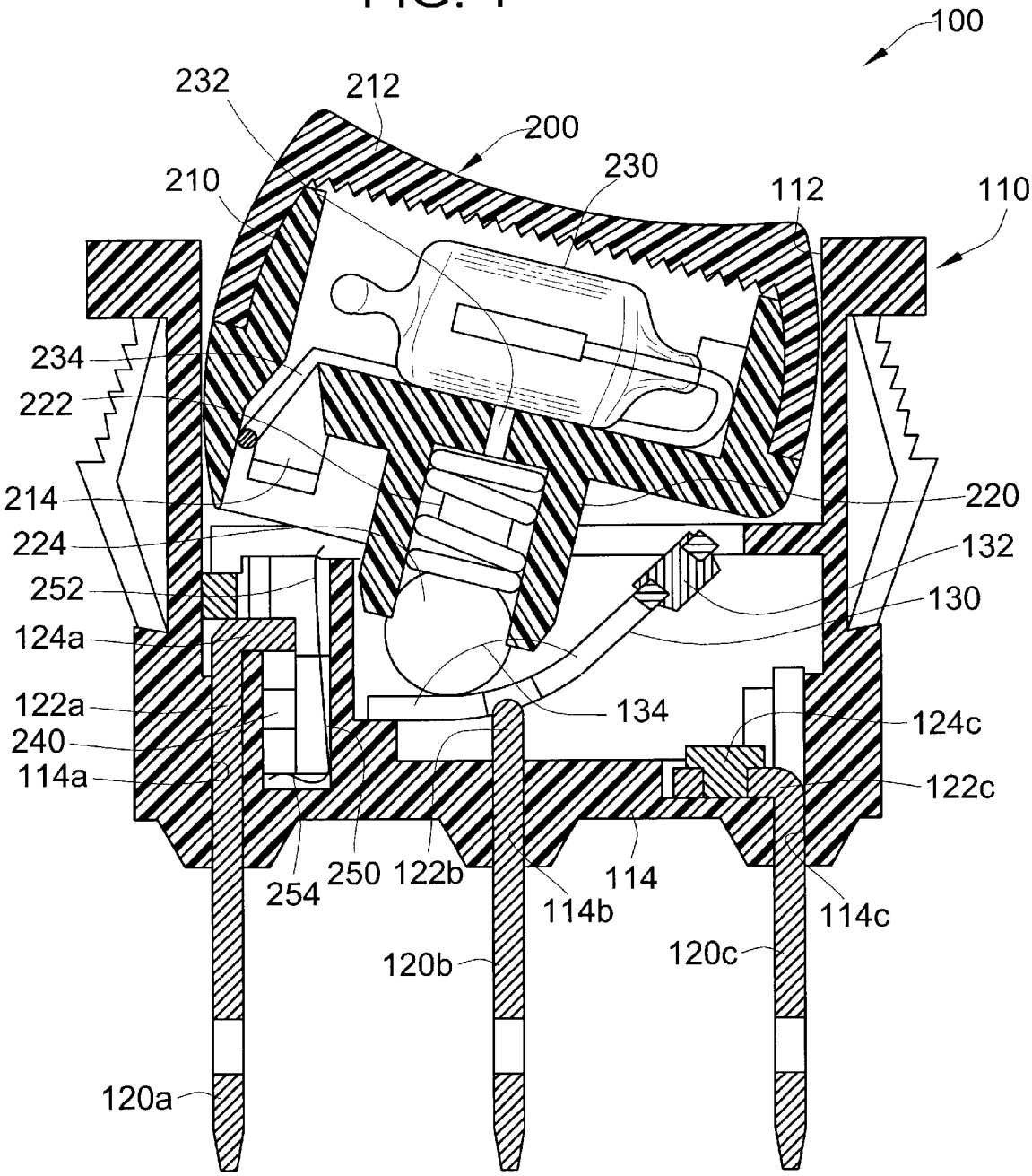
FIG. 1 is a cross-sectional side view of an embodiment of an electrical switch in accordance with the invention, which includes a light bulb and a resistor therefor.
Figure 2:
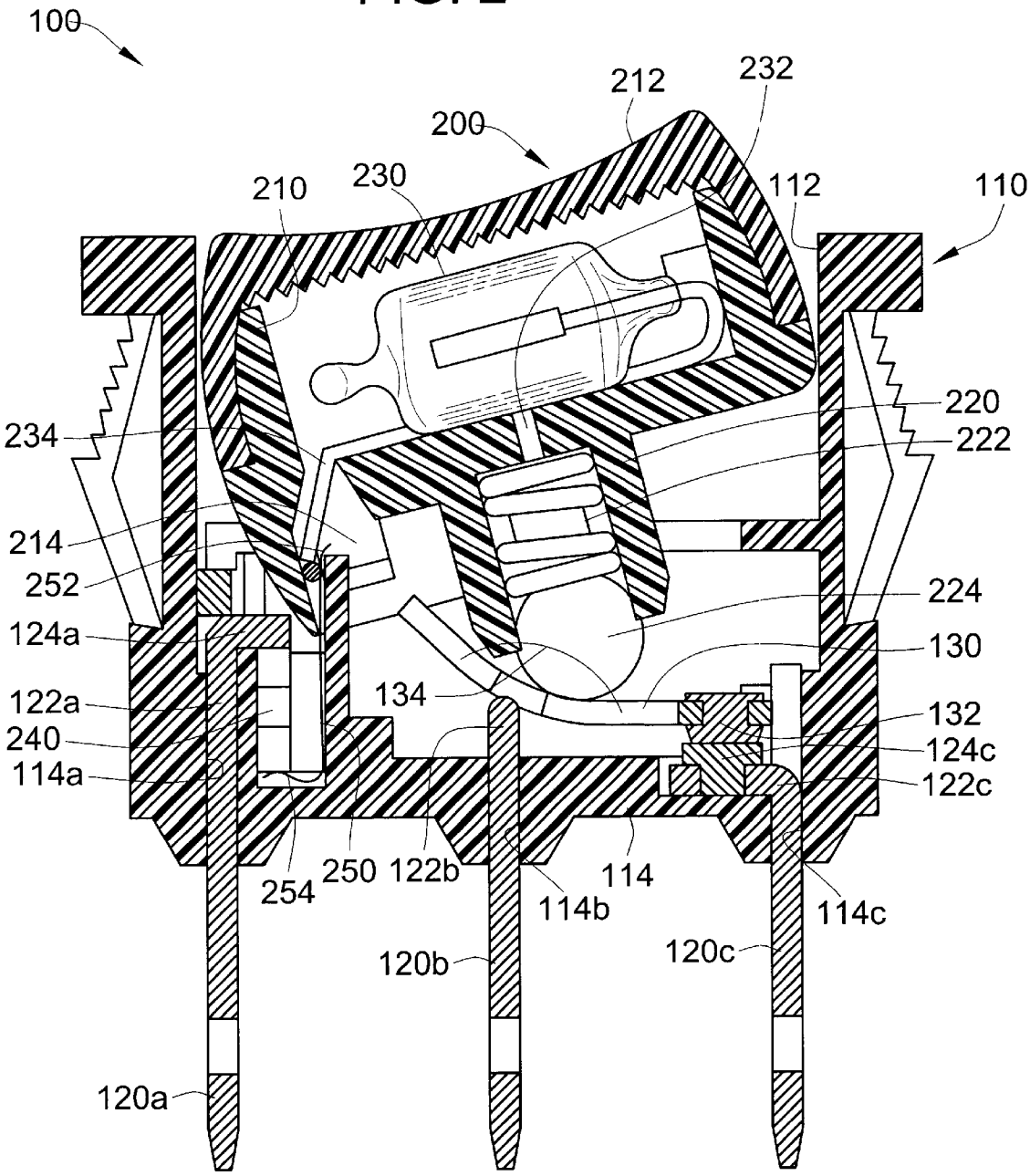
FIG. 2 is a cross-sectional side view corresponding to FIG. 1, showing the switch in a switched-on condition.

Referring to the drawings, there is shown an electrical switch 100 embodying the invention, which switch 100 is in the form of a rocker switch 100 comprising a rectangular plastic casing 110 and an oblong plastic operating rocker. 200 supported within the casing 110 for pivotal movement between an inoperating position (FIG. 1) and an operating position (FIG. 2). The casing 110 has an oblong top opening 112 exposing the rocker 200 for rocking movement by a user. The rocker 200 has a body 210 which includes a translucent outer cover 212 and houses a neon light bulb 230, having an operating voltage of 12V for example, for lighting up to indicate when the rocker 200 is in the operating position. A resistor 240 is provided within the casing 110, for series connection with the light bulb 230 such that the light bulb 230 can operate at 12V.

The switch 100 includes three fixed contacts 120A/B/C provided by respective generally flat contact pine 120A/B/C. The contact pins 120A/B/C extend vertically from inside to outside the casing body 112 through corresponding slots 114A/B/C formed in a base wall 114 of the casing 110 at respective left end, middle and right end positions as shown. The left contact pin 120A has an inner end 122A including a 90° bent, laterally outwardly protruding, central lug 124A in direct engagement with the resistor 240. The right contact pin 120C has an inner end 122C which is bent through 90° and mounts a contact member 124C. The middle contact pin 120B has an inner end 122B which is bifurcated and acts as a pivot to support a moving contact 130 of the switch 100.

The moving contact 130 is in the form of a curved lever 130 which is provided at one end with a contact member 132 for electrical contact with the fixed contact member 124C below it. The middle contact pin 120B supports the contact lever 130 at about two-third of its length for pivotal movement by the rocker 200 downwards to bring its contact member 132 into contact with the fixed contact member 124C and upwards to remove the former from the latter. As the contact lever 130 is always in electrical contact with the middle contact pin 120B through the support thereby, its pivotal movement results in the making and breaking of electrical connection between the middle and the right contact pins 120B and 120C. These two contact pins 120B and 120C constitute a pair of principal terminals of the switch 100 for connection to a load and a power source. The contact lever 130 has an upwardly concave section 134 extending across opposite sides of its pivot point, along which the rocker 200 acts upon.

The rocker 200 includes a central tube 220 depending from the body 210, which houses a compression coil spring 222 therein and supports a metal ball 224 at the lowermost end. The ball 224 is biassed by the spring 222 outwards to resiliently bear against and act upon the concave section 134 of the contact lever 130. Upon rocking movement between its operating and its inoperating positions, the rocker 200 pivots the contact lever 130 downwards and upwards respectively, in the opposite direction, by means of its ball 224 sliding along the lever section 134 across the latter's pivot point.

The light bulb 230 has a pair of terminals 232 and 234. The first terminal 232 extends through a base wall of the rocker body 210 to reach the coil spring 222. As both the spring 222 and the ball 224 are conductive, the first terminal 232 is always in electrical connection with the contact lever 130 and in turn the middle contact pin 120B. The second terminal.234 extends to reach the left end of the rocker body 210, where it is supported and exposed through a bottom opening 214 of the body 210.

The resistor 240 is of the type generally known as SMD (surface mounted device) or chip resistors, having a flat rectangular body 242 and a pair of terminals 244 and 246 in the form of contact pads formed on and around opposite end surfaces of the body 242. The resistor 240 is received slidably in a vertical slot 116 of practically the same cross-section. The slot 116 is formed in or right above the base wall 114 of the casing 110 next and parallel to the left contact slot 114A. A yet further vertical slot 118 is formed next and parallel to the resistor slot 116, for locating an electrical connector 250. The two slots 116 and 118 are in communication with each other through an intermediate cavity 117 of a reduced width.

Figure 6:
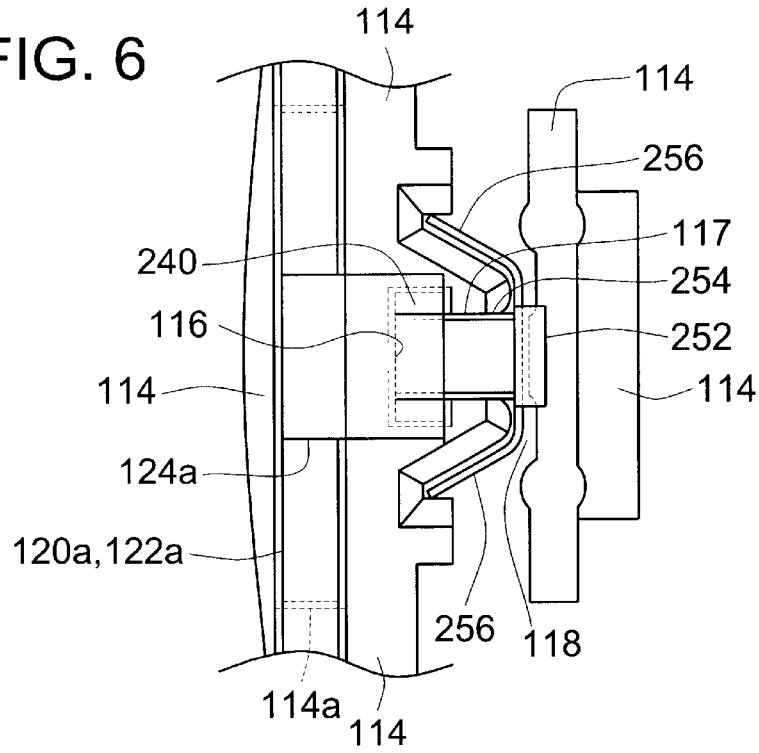
FIG. 6 is a top plan view of the switch part of FIG. 5.
Figure 5:
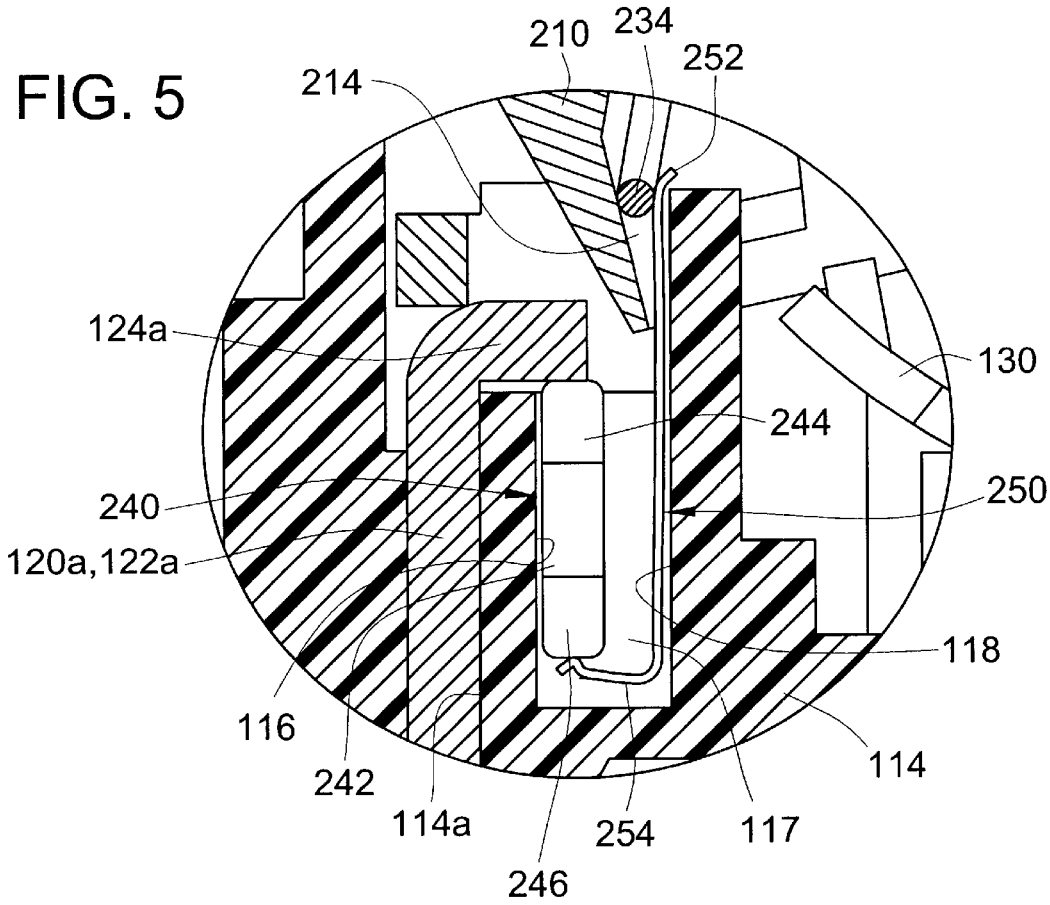
FIG. 5 is a cross-sectional side view of part of the switch of FIG. 2, showing the resistor located inside the switch casing by the switch contact and connector.

The connector 250 is provided by a resilient metal strip which has an extended top end 252, a 90° bent bottom end lug 254 of a reduced width, and a pair of 45° turned left and right side wings 256. The lug 254 and wings 256 protrude on the same principal side of the connector 250. The slot 118 has one side of the same double-turned shape as the cross-section of the connector 250 with wings 256 and includes an opposite side that is flat, for receiving and locating the connector 250 by its wings 256 and its opposite principal side (FIG. 6).

The connector 250 is located such that its bottom end lug 254 extends horizontally through the cavity 117 into the lower end of the resistor slot 116. Its upper end 252 extends vertically upwards to reach lose to the bottom opening 214 of the rocker body 210 that exposes the second light bulb terminal 234 (FIG. 1), for contact by this terminal 234 when the rocker 200 is pivoted to the operating position (FIG. 2 or 6).

Each contact pin 120A/B/C is inserted downwardly through the respective slot 114A/B/C and then expanded slightly on the lower side of the casing base wall 114 for being fixed in position. In the case of the left contact pin 120A, its top end lug 124A overlies the upper end of the adjacent slot 116. The resistor 240 is held fixed within the slot 116 by being clamped between the top end lug 124A of the left contact pin 120A and the bottom end lug 254 of the connector 250. The resistor 240 lies adjacent and parallel to the contact pin end 122A, and the connector 250 lies adjacent and parallel to the resistor 240. To assemble, the connector 250 is firstly inserted into its slot 118, then the resistor 240 into its slot 116, and finally the left contact pin 120A into its slot 114A (FIG. 3).

While the resistor 240 is located in the slot 116, its upper and lower terminals 244 and 246 are in direct engagement and hence electrical contact with the two end lugs 124A and 254 respectively, whereby the resistor 240 is fixed in position and is electrically connected between the left contact pin 120A and the connector 250.

As described above, the connector 250 is subsequently contactable by the second terminal 234 of the light bulb 230, whose first terminal 232 is in turn connected via the spring 222, ball 224 and moving contact 130 to the middle contact pin 120. Thus, the light bulb 230 and resistor 240 are connectable in series across the two contact pins 120A and 120B, which constitute a pair of auxiliary terminals of the switch 100 for connecting the light bulb 230 to the same power source as the load.

The load circuit associated with the middle and right contact pins 120B and 120C and the light bulb circuit associated with the left and middle contact pins 120A and 120C are switched on (FIG. 1) and off (FIG. 2) simultaneously, upon the rocker 200 pivoting the contact lever 130 in opposite direction. The light bulb 230 acts as a pilot lamp to indicate the switched on condition.

The resistor 240, that being a SMD resistor, is compact in size. Its connection and fixing through mere contact with the left contact pin 120A in particular, and the connector 250, are simple and easy to achieve. The direct contact has an additional advantage, in that the Contact pin 120A can also readily act as a heat sink for the resistor 240.

It is envisaged that the subject invention may be applied to any other kinds of electrical switches, such as push-button switches, slide switches and rotary switches.

The invention has been given by way of example only, and various other modifications and/or variations to the described embodiment may be made by persons skilled in the art without departing from the scope of the invention as specified in the accompanying claims.

What is claimed is:

1. An electrical switch comprising:

a casing, at least three fixed contacts extending from inside of to outside of the casing, each contact having an inner end portion, an operating member supported within the casing for movement between an operating position and a non-operating position, an internal moving contact movable by the operating member to make and break electrical connection between the inner end portions of a first pair of the fixed contacts while the operating member is in the operating and non-operating positions, respectively, the first pair of the fixed contacts being connectable to a load and a power source, an internal lighting element lighting to indicate when the operating member is in the operating position, and an internal resistor for the lighting element wherein, the lighting element and the resistor are connected in series across the inner end portions of a second pair of the fixed contacts when the operating member is in the operating position, the second pair of fixed contacts being different from the first pair of fixed contacts with respect to one fixed contact, the second pair of fixed contacts are connectable to a power source, and the resistor is located in a fixed position, has a resistor body, and has first and second terminals, the first terminal comprising a first contact pad on a surface of the body, in direct engagement with the inner end portion of a first of the fixed contacts of the second pair of fixed contacts for electrical connection to the first of the fixed contacts, and fixed in position, and wherein the second resistor terminal comprises a second contact pad on a surface of the resistor body and in direct engagement with an electrical connector for connection to a second terminal of the lighting element.

2. The electrical switch as claimed in claim 1, wherein the inner end portion of the first fixed contact of the second pair of fixed contacts has a part that protrudes laterally outwards and engages the first terminal, with the resistor body lying adjacent and substantially parallel to a contact end portion of the switch.

3. The electrical switch as claimed in claim 1, wherein the resistor body has opposite end surfaces on which the first and second terminals of the resistor are respectively located, and the resistor is clamped at the first and second terminals of the resistor between the inner end portion of the first fixed contact of the second pair of fixed contacts and a part of the electrical connector.

4. The electrical switch as claimed in claim 3, wherein the resistor is located between the inner end portion of the first fixed contact of the second pair of fixed contacts and the electrical connector.

5. The electrical switch as claimed in claim 1, wherein the lighting element is located within the operating member, and includes a first terminal in contact with the moving contact.

6. The electrical switch as claimed in claim 5, wherein the second terminal of the lighting element is supported by the operating member for movement to contact the electrical connector when the operating member is in the operating position.

7. The electrical switch as claimed in claim 1, wherein the lighting element is located within the operating member, and has a second terminal movable by the operating member for connection to the second terminal of the resistor when the operating member is in the operating position, and including a first terminal connected to the moving contact.

8. The electrical switch as claimed in claim 1, wherein the resistor body is substantially rectangular.

9. The electrical switch as claimed in claim 1, wherein the resistor is a surface mounted device.

10. The electrical switch as claimed in claim 1, being a rocker switch, wherein the operating member is supported for pivotal movement between the operating and the non-operating positions, and the moving contact is supported for pivotal movement by a second of the fixed contacts of the second pair of fixed contacts, the moving contact being conductively spring biased by the operating member for pivotal movement in a direction opposite the pivotal movement of the operating member.

11. An electrical switch comprising:

a casing, at least three fixed contacts extending from inside of to outside of the casing, each contact having an inner end portion, an operating member supported within the casing for movement between an operating position and a non-operating position, an internal moving contact movable by the operating member to make and break electrical connection between the inner end portions of a first pair of the fixed contacts while the operating member is in the operating and non-operating positions, respectively, the first pair of the fixed contacts being connectable to a load and a power source, an internal lighting element lighting to indicate when the operating member is in the operating position, and an internal resistor for the lighting element wherein, the lighting element and the resistor are connected in series across the inner end portions of a second pair of the fixed contacts when the operating member is in the operating position, the second pair of fixed contacts being different from the first pair of fixed contacts with respect to one fixed contact, the second pair of fixed contacts are connectable to a power source, and the resistor is located in a fixed position, has a resistor body, and has first and second terminals, the first terminal comprising a first contact pad on a surface of the body, in direct engagement with the inner end portion of a first of the fixed contacts of the second pair of fixed contacts for electrical connection to the first of the fixed contacts, and fixed in position, and wherein the casing includes a slot receiving the resistor, the casing and the resistor having substantially identical cross-sections.

12. The electrical switch as claimed in claim 11, wherein the inner end portion of the first fixed contact of the second pair of fixed contacts has a part that protrudes laterally outwards and engages the first terminal, with the resistor body lying adjacent and substantially parallel to a contact end portion of the switch.

13. The electrical switch as claimed in claim 11, wherein the lighting element is located within the operating member, and has a second terminal movable by the operating member for connection to the second terminal of the resistor when the operating member is in the operating position, and including a first terminal connected to the moving contact.

14. The electrical switch as claimed in claim 11, wherein the resistor body is substantially rectangular.

15. The electrical switch as claimed in claim 11, wherein the resistor is a surface mounted device.

16. The electrical switch as claimed in claim 11, being a rocker switch, wherein the operating member is supported for pivotal movement between the operating and the non-operating positions, and the moving contact is supported for pivotal movement by a second of the fixed contacts of the second pair of fixed contacts, the moving contact being conductively spring biased by the operating member for pivotal movement in a direction opposite the pivotal movement of the operating member.

* * * * *